US005927640A

United States Patent [19]

Yokoe

[11] Patent Number: 5,927,640

[45] Date of Patent: Jul. 27, 1999

[54] METHOD AND APPARATUS FOR WINDING TAPE-LIKE ARTICLE

[75] Inventor: Kazuo Yokoe, Toyama, Japan

[73] Assignee: YKK Corporation, Tokyo, Japan

[21] Appl. No.: 08/918,418

[22] Filed: Aug. 26, 1997

[30] Foreign Application Priority Data

Aug. 30, 1996 [JP] Japan ..... 8-229608

[51] Int. Cl.[6] ..... B65H 18/10; B65H 19/28

[52] U.S. Cl. ..... 242/530.1; 242/532

[58] Field of Search ..... 242/530.1, 530.3, 242/532, 532.7, 541.3, 547

[56] References Cited

U.S. PATENT DOCUMENTS

| | | | |
|---|---|---|---|
| 2,821,347 | 1/1958 | Stephens | 242/532 |
| 4,175,714 | 11/1979 | Dreher | 242/530.1 |
| 4,934,224 | 6/1990 | Brown | 242/532.7 |
| 5,381,982 | 1/1995 | Adamski | 242/541.3 |

FOREIGN PATENT DOCUMENTS

| | | | |
|---|---|---|---|
| 645724 | 2/1979 | Russian Federation | 242/541.3 |
| 546126 | 6/1942 | United Kingdom . | |
| 781299 | 8/1957 | United Kingdom . | |
| 911940 | 12/1962 | United Kingdom . | |
| 1026941 | 4/1966 | United Kingdom . | |
| 1090881 | 11/1967 | United Kingdom | 242/541.3 |
| 1536465 | 12/1978 | United Kingdom . | |

*Primary Examiner*—John M. Jillions
*Attorney, Agent, or Firm*—Hill & Simpson

[57] ABSTRACT

With leading ends of a number of tape-like articles in contact with a number of take-up spools mounted on a winding shaft, an endless belt is advanced by a cylinder to press against and grasp the take-up spools. Then the winding shaft and the endless belt are operated in synchronism with each other to roll the individual tape-like articles around the respective take-up spools several times. Then the winding shaft and the endless belt are stopped and the endless belt is retracted, whereupon the winding shaft is rotated again so that the tape-like articles are automatically wound on the take-up spools. The endless belt is supported by and extends around two front rollers and two rear rollers. The front rollers are pivotally mounted on front ends of two arms pivotally connected at rear ends to the respective rear rollers so that the take-up spools can be reliably grasped by the endless belt folded in a U shape.

9 Claims, 4 Drawing Sheets

METHOD AND APPARATUS FOR WINDING TAPE-LIKE ARTICLE

BACKGROUND OF THE INVENTION

1. Field of the Invention

This invention relates to a method of and an apparatus for automatically winding a continuous length of tape-like article, such as a surface fastener, a slide fastener chain or an ornamental tape, on a spool stably and uniformly.

2. Description of the Related Art

Japanese Utility Model Publication No. Hei 1-38108 discloses a film winder. In this film winder, as shown in FIG. 6 of the accompanying drawings, in order to wind a large-width film 1' on a take-up roller 3', an endless belt 4' for driving the take-up roller 3' is pressed against the take-up roller 3' in such a manner that the endless belt 4' contacts with part of the take-up roller 3' of a variable width in a circumferential direction of the take-up roller 3', and further an idle roller 16 is pressed against the endless belt 4' under the resiliency of a spring 13'. Further, the film winder includes a tension compensating mechanism for keeping the endless belt 4' in constant tension with respect to the take-up roller 3' varying its diameter commensurate with a quantity of the film windings.

According to this conventional winder, since the endless belt 4' is supported by and extends around three fixed rollers 5', 6' to be pressed against the take-up roller 3', it is difficult to bring the leading end of the film 1' into contact with the take-up roller 3' so that reliable winding cannot be realized. Further, since the endless belt 4' used in this winder is a double form composed of two laterally spaced small-width belts, the winder is not suitable as an apparatus for taking up a number of small-width tapes at once.

SUMMARY OF THE INVENTION

With the foregoing problems in view, it is a first object of this invention to provide a method of winding a tape-like article in which a tape-like article, such as a surface fastener can be rolled reliably and smoothly on a take-up spool mounted on a winding shaft, thus enabling automated windings.

A second object of the invention is to provide a method of winding a tape-like article in which a number of tapes can be rolled simultaneously and uniformly on a number of take-up spool mounted on a single winding shaft, thus enabling automated winding.

A third object of the invention is to provide a method of winding a tape-like article in which leading ends of a number of tapes can be twisted without fail on a number of take-up spools mounted on a single winding shaft.

A fourth object of the invention is to provide an apparatus for winding a tape-like article having a simple winder mechanism, comprising a combination of a winding shaft, a take-up spool and an endless belt, in which a tape-like article such as a surface fastener can be rolled reliably and smoothly on the take-up spool, thus enabling automated winding.

A fifth object of the invention is to provide an apparatus for winding a tape-like article in which a tape can be rolled smoothly on a take-up spool as an endless belt is reliably moved by specifying an endless-belt supporting and winding mechanism, thus enabling automated winding.

A sixth object of the invention is to provide an apparatus for winding a tape-like article in which rolling of a tape-like article can be achieved as a take-up spool is reliably grasped by an endless belt supported on a specified support mechanism, thus enabling automated winding.

A seventh object of the invention is to provide an apparatus for winding a tape-like article in which a number of tapes can be simultaneously rolled uniformly and efficiently on a number of take-up spools, thus enabling automated winding.

According to a first aspect of the invention, the first object can be accomplished by a method of winding a tape-like article, comprising: a first step of bringing a leading end of the tape-like article into contact with a take-up spool mounted on a winding shaft; a second step of advancing an endless belt to the winding shaft to press the tape-like article against the take-up spool; a third step of rotating the winding shaft, with moving the endless belt in synchronism with the rotating of the winding shaft, to roll the tape-like article around the take-up spool several times; a fourth step of retracting the endless belt from the winding shaft to release the pressing of the tape-like article; and a fifth step of rotating the winding shaft again to render the take-up spool to automatically take up the tape.

According to a second aspect of the invention, in addition to the features of the first aspect of the invention, the first step alternatively includes bringing leading ends of a plurality of tape-like articles respectively into contact with a plurality of take-up spools mounted on the winding shaft, and the second step alternatively includes advancing a large-width endless belt to press the tape-like articles against the respective take-up spools.

According to a third aspect of the invention, in addition to the features of the first aspect of the invention, the second step alternatively includes advancing the endless belt to the winding shaft to grasp the take-up spool by the endless belt folded in a U shape.

According to a fourth aspect of the invention, the fourth object is accomplished by an apparatus for winding a tape-like article, comprising: a winding shaft; a take-up spool detachably mounted on the winding shaft; and an endless belt supported and wound around a roller assembly including a pair of mutually vertically movable front rollers, the roller assembly being horizontally movable toward and away from the take-up spool for grasping the take-up spool by the endless belt in a U-folded form.

According to a fifth aspect of the invention, in addition to the feature of the fourth aspect of the invention, said roller assembly further includes a pair of rear rollers.

According to a sixth aspect of the invention, in addition of the features of the fourth aspect of the invention, said roller assembly further includes at least one rear roller larger in diameter than the take-up spool.

According to a seventh aspect of the invention, in addition to the feature of the fifth or six aspect of the invention, the pair of front rollers are respectively connected to said rear roller via upper and lower arms, each of the upper and lower arms being pivotally movable about its rear end.

According to an eighth aspect of the invention, in addition to the feature of the fourth aspect of the invention, a number of take-up spools are mounted on the winding shaft, and the endless belt is large in width for being pressed against all of the take-up spools throughout its entire width.

DETAILED DESCRIPTION OF THE PREFERRED EMBODIMENTS

Figure 1:
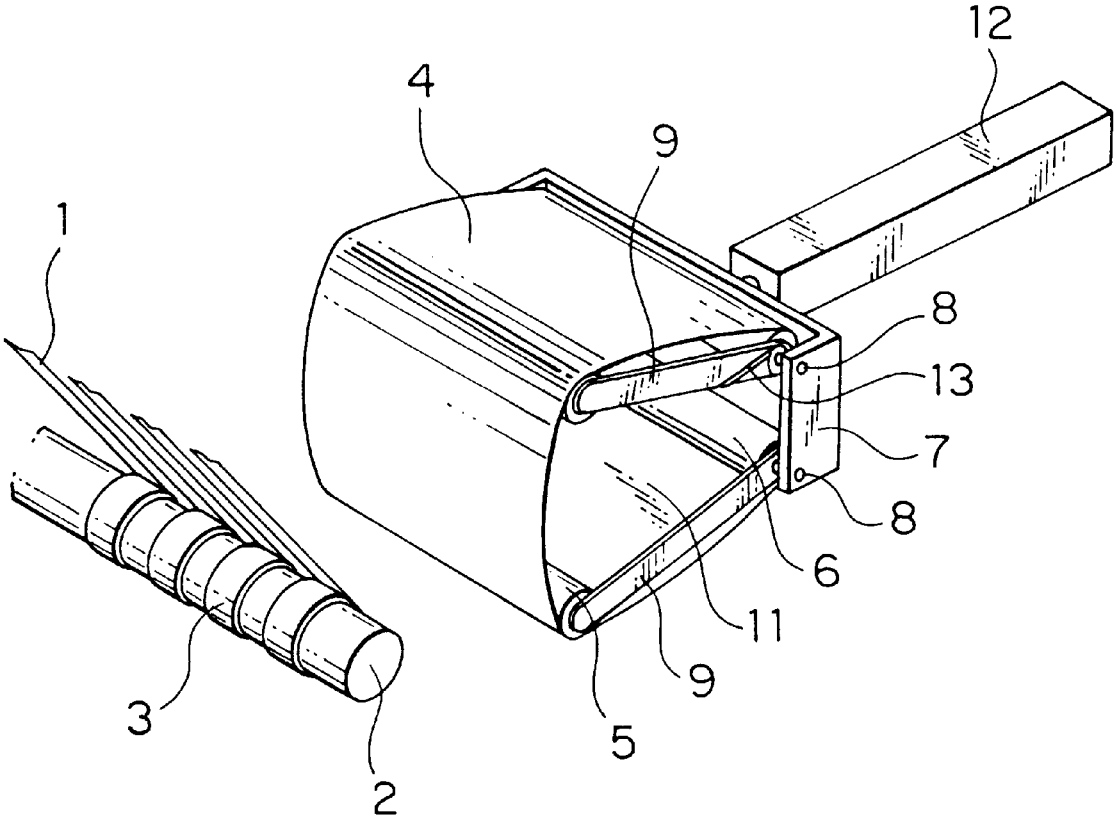
FIG. 1 is a perspective view of an apparatus for winding a tape-like article according to a first embodiment of this invention.

Preferred embodiments of a method and an apparatus for winding a tape-like article (hereinafter called the winding method and the winding apparatus) according to this invention will now be described in detail with reference to the accompanying drawings.

The winding method of the invention is a method of automatically winding a number of continuous-length tapes 1 (each hereinafter called the tape 1), such as surface fasteners, slide fastener chains or ornamental tapes, on a number of take-up spools 3 detachably mounted on a single winding shaft 2 of the tape winding apparatus, such as an automatic winder. As a first step of the winding method, a leading end of each tape 1 is gripped by a grip mechanism or by hand to bring the leading end of the tape 1 into contact with a side of the corresponding take-up spool 3 confronting with the endless-belt.

As a second step, an endless belt 4 confronting the winding shaft 2 is advanced toward the winding shaft 2 and, at the same time, a leading end portion of each tape 1 is pressed against the corresponding take-up spool 3. At that time, the endless belt 4 assumes a U- folded form for grasping the individual take-up spools 3 reliably.

Then, as a third step, while the winding shaft 2 is rotated, the endless belt 4 is rotated In synchronism with the movement of the winding shaft 2 so that each tape 1 is rolled around the corresponding take-up spool 3 several times. At that time, the endless belt 4 in a U-folded form grasps the take-up spools 3 to perform the rolling of the tape 1.

Then, as a fourth step, the endless belt 4 pressing the take-up spools 3 which are mounted on the winding shaft 2 and rotating in synchronism with the movement of the winding shaft 2 is retracted from the take-up spools 3 so that the tape is released from pressing.

Finally, as a fifth step, the winding shaft 2 is rotated to roll the tape 1 on the corresponding take-up spools 3, which are mounted on the winding shaft 2, uniformly by a predetermined length. Thus the tapes 1 are wound on the take-up spools 3 automatically.

The winding apparatus of the invention is an apparatus for automatically winding a number of continuous-length tapes 1, such as surface fasteners. In the winding apparatus, a number of take-up spools 3 for taking up a number of tapes 1 are detachably mounted on a single winding shaft 2, while an endless belt 4 is disposed in confronting relation to the take-up spools 3 so as to be movable toward and away from the take-up spools 3, as shown in FIG. 1.

The endless belt 4 is supported by a pair of vertically arranged front rollers 5, 5 and a pair of vertically arranged rear rollers 6, 6. The rear rollers 6, 6 are respectively mounted on pivots 8, 8 which are supported by a generally C-shaped frame 7 and are arranged vertically, and connected to the front rollers 5, 5 via the upper and lower arms 9, 9 of which bases are pivotally mounted on the pivots 8, 8 so that each of their free ends is movable in an arc about the respective pivot 8. And the front rollers 5, 5 are rotatably supported on the respective free ends of the upper and lower arms 9, 9 by pivots 10, 10. The endless belt 4 extends over and round the front rollers 5, 5 and the rear rollers 6, 6 to define a hollow 11 inside thereof so that the winding shaft 2 can be received in the hollow 11 as described below.

Figure 3:
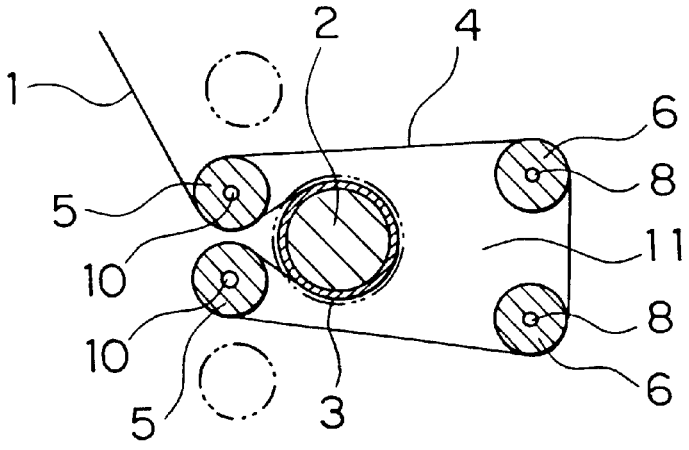
FIG. 3 is a diagram showing the apparatus of the first embodiment when only a leading end portion of the tape-like article is wound.

The frame 7 is connected to a horizontal reciprocating cylinder 12; when the cylinder 12 strokes forward, the endless belt 4 grasps the winding shaft 2 in a U-folded form between the upper and lower front rollers 5, 5 as the endless belt 4 is pushed into the hollow 11 by the winding shaft 2 as shown in FIG. 3. Accordingly, each front roller 5 is moved in an arc about the base of the corresponding arm 9 by the pivotal movement of the arm 9.

As shown in FIG. 1, the upper arm 9 is normally urged upwardly by a tension spring 13 connected at one end to the pivot 8 of the upper rear roller 6 and at the other end to the upper arm 9. Since the lower arm 9 is moved downwardly by its own weight, it does not need any tension spring. However, if it is preferable to positively keep the front rollers 5, 5 open, the lower arm 9 may also be equipped with such a tension spring.

Figure 2:
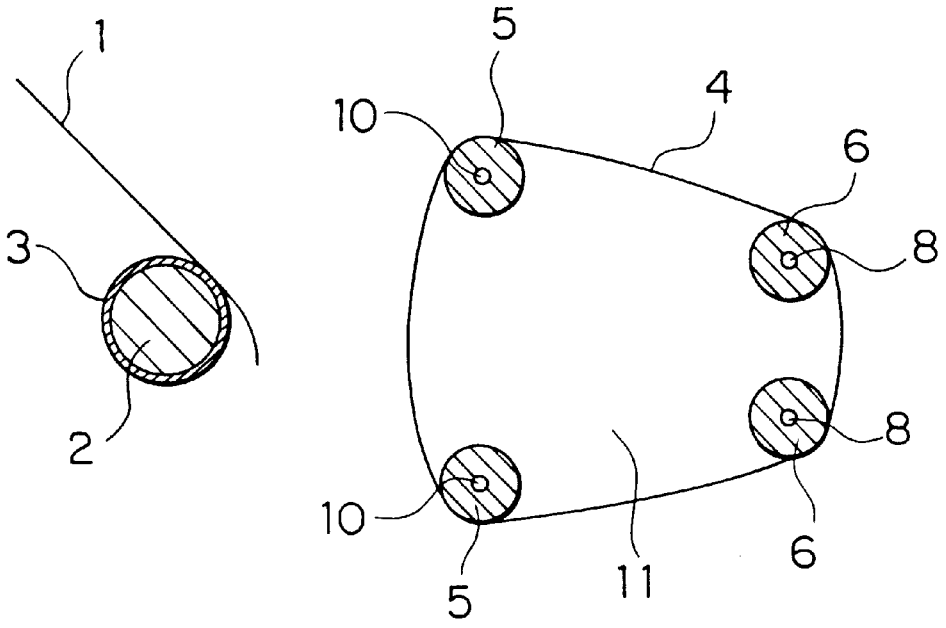
FIG. 2 is a diagram showing the apparatus of the first embodiment at the initial stage of the operation of the apparatus.

In operation, firstly the take-up spools 3 are mounted on the winding shaft 2 and then leading ends of the individual tapes 1 are gripped by a grip mechanism (not shown) or manually and are brought into contact with the corresponding take-up spools 3 on a side confronting the endless belt 4 as shown in FIG. 2. With the leading ends of the tapes 1 contacting the take-up spools 3, the endless belt 4 is advanced by the cylinder 12 to grasp the winding shaft 2 as shown in FIG. 3, whereupon the winding shaft 2 is rotated, in response to which the endless belt 4 also runs around the two front rollers 5, 5 and the two rear rollers 6, 6, thus rolling the individual tapes 1 on the corresponding take-up spools 3 several times. Then the rotation of the winding shaft 2 is stopped and, at the same time, the running of the endless belt 4 also is stopped, whereupon the endless belt 4 is retracted from the winding shaft 2 by the cylinder 12.

Figure 4:
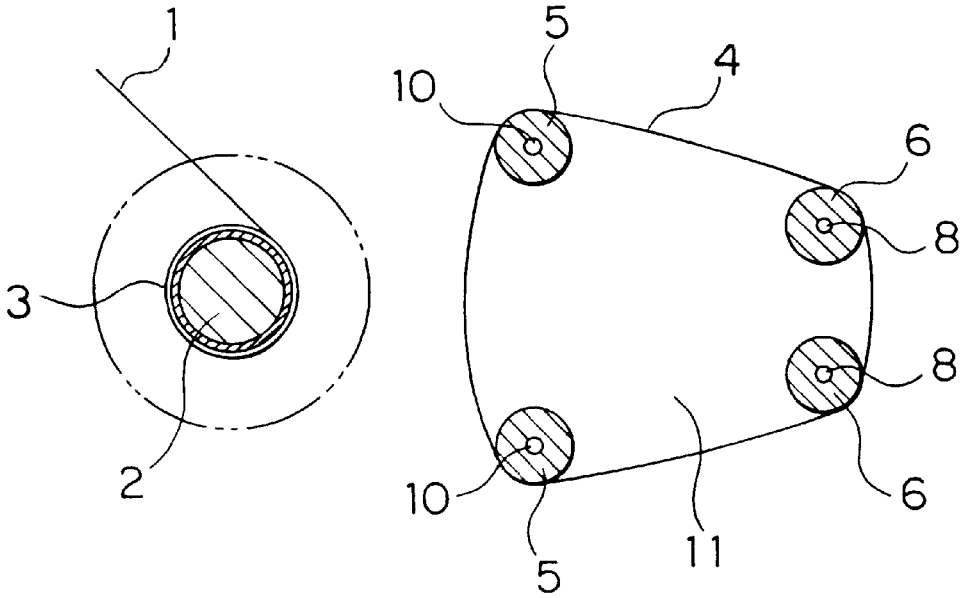
FIG. 4 is a diagram showing the apparatus when the tape-like article is automatically wound.

When the endless belt 4 is thus retracted, the winding shaft 2 is rotated again to wind the tapes 1 one on each of the take-up spools 3 by a predetermined length automatically, as shown in FIG. 4.

Figure 5:
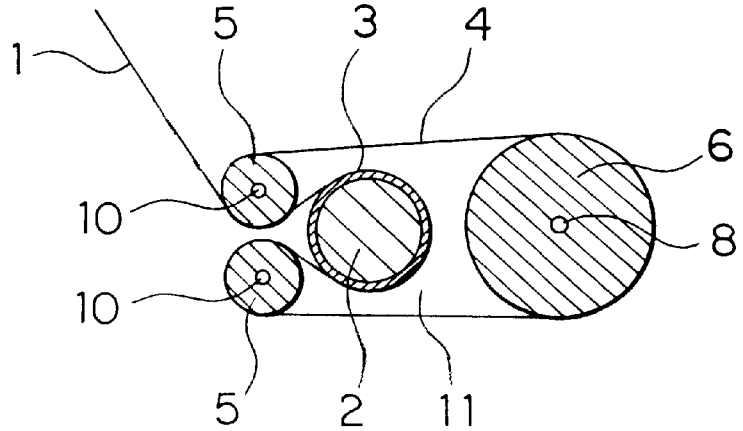
FIG. 5 is a diagram showing a modified apparatus according to another embodiment when only a leading end portion of the tape-like article is wound.
Figure 6:
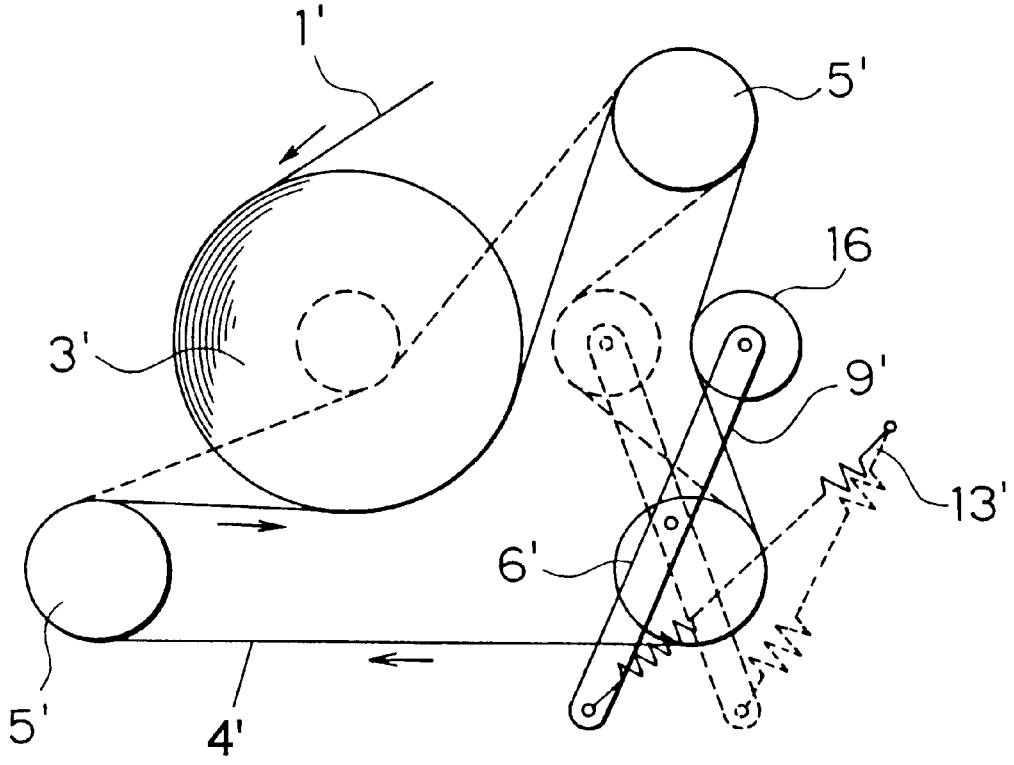
FIG. 6 PRIOR ART
FIG. 6 is a diagram showing the operation of a conventional winding apparatus.

FIG. 5 shows a modified winding apparatus in which the endless belt 4 is supported by and extends around three rollers, instead of four rollers of the previous apparatus. Namely, this modified roller assembly is composed of a pair of vertically arranged front rollers 5, 5 and a single rear roller 6 which is larger in diameter than each take-up spool 3 mounted on a winding shaft 2. The rear roller 6 is rotatably supported on a frame 7 (FIG. 1), which is connected to a cylinder 12 (FIG. 1), by a pivot 8 on which upper and lower arms 9, 9 (FIG. 1) are pivotally mounted. The front rollers 5, 5 are rotatably supported on the respective free ends of the upper and lower arms 9, 9.

Following are advantageous results that can be obtained with the winding method and apparatus of this invention:

According to the first aspect of the invention, since the winding method comprises the steps of bringing a leading end of tape 1 on the take-up spool 3 mounted on the winding shaft 2, pressing the tape 1 against the take-up spool 3 by the endless belt 4, rolling the tape 1 around the take-up spool 3 several times by the cooperation of the winding shaft 2 and the endless belt 4, stopping the rotation of the winding shaft 2 and, at the same time, retracting the endless belt 4 to release pressing the tape 1, and rotating the winding shaft 2 again to take up the tape 1 on the take-up spools 3, it is possible to wind the tape 1 on the take-up spool 3 reliably and smoothly by an efficient combination of simple operating mechanisms, thus realizing automatic winding.

According to the second aspect of the invention, since the winding method alternatively includes mounting a number of take-up spools 3 on the winding shaft 2 and bringing leading ends of a number of tapes 1 into contact with the respective take-up spools 3, and advancing a large-width endless belt 4 to press the tapes 1 against the corresponding take-up spools 3, it is possible to wind a large quantity of tapes 1 uniformly, thus improving the rate of production.

According to the third aspect of the invention, since the winding method further includes grasping the take-up spool 3 by the U endless belt 4 folded in a U shape, it is possible to hold the tape 1 stably so that the tape 1 can be rolled on the take-up spool 3 reliably and efficiently, thus realizing automatic winding.

According to the fourth aspect of the invention, since the winding apparatus comprises a winding shaft 2, a take-up spool 3 detachably mounted on the winding shaft 2, and an endless belt 4 for pressing the tape 1, supported by and extending around a roller assembly, which includes a pair of vertically movable front rollers 5, 5, for reciprocating movement toward and away from the take-up spool 3, it is possible to roll the tape 1 on the take-up spool 3 reliably and smoothly by an efficient combination of simple operating mechanisms, thus realizing automated winding.

According to the fifth aspect of invention, since the roller assembly by which the endless belt 4 is supported so as to run around includes, in addition to the two front rollers 5, 5, a pair of rear rollers 6, 6, it is possible to support the endless belt 4 in a stabilized form by the roller assembly and to grasp the take-up spool 3 in a simple action so that smooth winding can be expected.

According to sixth aspect of the invention, since the roller assembly includes, in addition of the two front rollers 5, 5, a single rear roller 6 which is larger in diameter than the take-up spool 3, it is possible to support the endless belt 4 in a stabilized form by the simple roller assembly and to grasp the take-up spool 3 in a simple action so that smooth winding can be expected.

According to seventh aspect of the invention, since the two front rollers 5, 5 are rotatably supported by the respective front ends of upper and lower arms 9, 9 of which rear ends are pivotally connected to the rear roller 6 in such a manner that the front end of each arm 9 can move in an arc about the rear end of the same arm 9, it is possible to move the pair of front rollers 5, 5 in an arc reliably and to grip the take-up spool 3 in a simple action.

According to an eighth aspect of the invention, partly since a number of take-up spools 3 are mounted on the winding shaft 2 and partly since a large-width endless belt 4 is disposed in confronting relation to the take-up spools 3 though its entire width, it is possible to roll all the tapes 1 on the corresponding take-up spools 3 at once uniformly and efficiently, thus realizing automated winding and improving the rate of production.

What is claimed is:

1. A method of winding a tape-like article, comprising:

(a) a first step of bringing a leading end of the tape-like article into contact with a take-up spool mounted on a winding shaft;

(b) a second step of advancing an endless belt to the winding shaft and moving a pair of front rollers toward each other to press the tape-like article against the take-up spool, in which a line tangential to both front rollers on a side facing the take-up spool does not intersect the take-up spool prior to winding the tape-like article on the take-up spool;

(c) a third step of rotating the winding shaft, with moving the endless belt in synchronism with said rotating of the winding shaft, to roll the tape-like article around the take-up spool several times;

(d) a fourth step of retracting the endless belt from the winding shaft to release said pressing of the tape-like article; and (e) a fifth step of rotating the winding shaft again to render the take-up spool to automatically take up the tape-like article.

2. A winding method of winding a tape-like article according to claim 1, wherein said first step alternatively includes bringing leading ends of a plurality of tape-like articles respectively into contact with a plurality of take-up spools mounted on the winding shaft, and said second step alternatively includes advancing a large-width endless belt to press the tape-like articles against the respective take-up spools.

3. A method of winding a tape-like article according to claim 1, wherein said second step alternatively includes advancing the endless belt to the winding shaft to grasp the take-up spool by the endless belt folded in a U shape.

4. An apparatus for winding a tape-like article, comprising:

(a) a winding shaft;

(b) a take-up spool detachably mounted on the winding shaft; and (c) an endless belt supported and wound around a roller assembly including a pair of mutually vertically movable front rollers, said front rollers being vertically movable toward and away from each other, said roller assembly being horizontally movable toward and away from said take-up spool for grasping said take-up spool by said endless belt in a U-folded form, said front rollers defining a line tangential to both front rollers on a side facing the take-up spool which does not intersect the take-up spool when said take-up spool is grasped by said endless belt prior to winding the tape-like article on the take-up spool.

5. An apparatus for winding a tape-like article according to claim 4, wherein said roller assembly further includes a pair of rear rollers.

6. An apparatus for winding a tape-like article according to claim 5, wherein said pair of front rollers are respectively connected to said rear roller via upper and lower arms, each of said upper and lower arms being pivotally movable about its rear end.

7. An apparatus for winding a tape-like article according to claim 4, wherein said roller assembly further includes at least one rear roller larger in diameter than said take-up spool.

8. An apparatus for winding a tape-like article according to claim 6, wherein said pair of front rollers are respectively connected to said rear roller via upper and lower arms, each of said upper and lower arms being pivotally movable about its rear end.

9. A tape winding apparatus according to claim 4, wherein a number of take-up spools are mounted on said winding shaft, and said endless belt is large in width for being pressed against all of said take-up spools throughout its entire width.

* * * * *